US008851958B2

(12) United States Patent
Pietsch

(10) Patent No.: US 8,851,958 B2
(45) Date of Patent: Oct. 7, 2014

(54) METHOD FOR THE SIMULTANEOUS DOUBLE-SIDE MATERIAL-REMOVING PROCESSING OF AT LEAST THREE WORKPIECES

(75) Inventor: Georg Pietsch, Burghausen (DE)

(73) Assignee: Siltronic AG, Munich (DE)

( * ) Notice: Subject to any disclaimer, the term of this patent is extended or adjusted under 35 U.S.C. 154(b) by 217 days.

(21) Appl. No.: 13/602,436

(22) Filed: Sep. 4, 2012

(65) Prior Publication Data

US 2013/0072093 A1 Mar. 21, 2013

(30) Foreign Application Priority Data

Sep. 16, 2011 (DE) ..... 10 2011 082 857

(51) Int. Cl.
*B24B 37/28* (2012.01)
*B24B 47/12* (2006.01)

(52) U.S. Cl.
CPC ..... *B24B 37/28* (2013.01); *B24B 47/12* (2013.01)
USPC ..... 451/57; 451/5; 451/41; 451/262; 451/268

(58) Field of Classification Search
CPC ..... B24B 11/10; B24B 7/17; B24B 37/08; B24B 7/228
USPC ..... 451/5, 41, 57, 262, 268
See application file for complete search history.

(56) References Cited

U.S. PATENT DOCUMENTS 3,395,494 A * 8/1968 Sogn ..... 451/1
3,813,828 A * 6/1974 Bennett ..... 451/28
4,205,489 A * 6/1980 Orlov et al. ..... 451/269
4,433,510 A 2/1984 Katagiri et al.
4,845,900 A * 7/1989 Suzuki et al. ..... 451/5
5,733,175 A * 3/1998 Leach ..... 451/41
5,777,450 A * 7/1998 Kono et al. ..... 318/568.11

(Continued)

FOREIGN PATENT DOCUMENTS

DE 3213252 A1 12/1982
DE 10007390 A1 10/2000

(Continued)

OTHER PUBLICATIONS

Preston, F., J. Soc. Glass Technol. 11 (1927), 214-256.

(Continued)

*Primary Examiner* — George Nguyen

(74) *Attorney, Agent, or Firm* — Leydig, Voit & Mayer, Ltd.

(57) ABSTRACT

A method for simultaneous double-side material-removing processing of at least three workpieces includes disposing the workpieces in a working gap between rotating upper and lower working disks of a double-side processing apparatus. The workpieces lie in freely movable fashion in respective openings in a guide cage and are moved under pressure in the working gap using the guide cage. Upon attaining a preselected target thickness of the workpieces, a deceleration process is initiated that includes reducing an angular velocity ωi(t) of a respective drive i of each of the upper working disk, lower working disk and guide cage to a standstill. The reducing is carried out such that ratios of the angular velocities $\omega_i(t)$ with respect to one another as a function of time t deviate by no more than 10% from initial ratios of the angular velocities $\omega_i(t)$ corresponding to when the preselected target thickness was attained.

11 Claims, 3 Drawing Sheets

(56) References Cited

U.S. PATENT DOCUMENTS

| | | | | |
|---|---|---|---|---|
| 5,958,794 | A | 9/1999 | Bruxvoort et al. | |
| 6,080,048 | A * | 6/2000 | Kotagiri et al. | 451/285 |
| 6,210,259 | B1 * | 4/2001 | Malkin et al. | 451/166 |
| 6,299,514 | B1 * | 10/2001 | Boller | 451/262 |
| 6,527,721 | B1 * | 3/2003 | Wittrock et al. | 600/446 |
| 7,037,174 | B2 * | 5/2006 | Chen et al. | 451/5 |
| 8,113,913 | B2 | 2/2012 | Pietsch et al. | |
| 2001/0056544 | A1 | 12/2001 | Walker et al. | |
| 2003/0104698 | A1 | 6/2003 | Taniguchi et al. | |
| 2004/0116052 | A1 * | 6/2004 | Chen et al. | 451/57 |
| 2007/0072423 | A1 * | 3/2007 | Hensel et al. | 438/689 |
| 2009/0104852 | A1 | 4/2009 | Pietsch et al. | |
| 2009/0311863 | A1 | 12/2009 | Hashii et al. | |
| 2010/0052882 | A1 * | 3/2010 | Sverrisson et al. | 340/426.11 |
| 2011/0287693 | A1 * | 11/2011 | Hosokawa et al. | 451/5 |

FOREIGN PATENT DOCUMENTS

| | | | |
|---|---|---|---|
| DE | 19937784 | A1 | 2/2001 |
| DE | 102007013058 | A1 | 9/2008 |
| DE | 102007049811 | A1 | 4/2009 |
| DE | 102008058638 | A1 | 5/2010 |
| EP | 2189240 | B1 | 11/2011 |
| JP | 62199354 | A | 9/1987 |
| JP | 62255063 | A | 11/1987 |
| JP | 2000263402 | A | 9/2000 |
| JP | 2001025947 | A | 1/2001 |
| JP | 2001308038 | A | 11/2001 |

OTHER PUBLICATIONS

Tönshoff et al., in: CIRP Annals-Manufacturing Technology, vol. 41 (2), (1992) 677-688.

* cited by examiner

METHOD FOR THE SIMULTANEOUS DOUBLE-SIDE MATERIAL-REMOVING PROCESSING OF AT LEAST THREE WORKPIECES

CROSS REFERENCE TO RELATED APPLICATIONS

This application claims priority to German Patent Application No. DE 10 2011 082 857.5, filed Sep. 16, 2011, which is hereby incorporated by reference herein in its entirety.

FIELD

The present invention relates to a method for the simultaneous double-side material-removing processing of at least three workpieces between a rotating upper working disk and a rotating lower working disk of a double-side processing apparatus.

BACKGROUND

Various products in modern industry require very precisely processed wafer-type workpieces. These are, for example, highly flat, high-purity annular wafers—afforded narrow tolerances in respect of dimensions—composed of glass or aluminum as substrates for the production of magnetic mass storage devices for computers (hard disks), optical glasses and "flats", semiconductor wafers for the production of photovoltaic cells, etc. Particularly stringent requirements are made of monocrystalline semiconductor wafers as starting material for functional components appertaining to electronics, microelectronics and microelectromechanics, the production of which will therefore be used hereinafter by way of example for illustrating the invention and the object on which it is based.

Group processing methods are particularly advantageous for the production of semiconductor wafers having a particularly uniform thickness (parallelism of front and rear sides of the semiconductor wafers) and flatness (planarity of front and rear sides), in which group processing methods both sides of the semiconductor wafers are simultaneously processed in material-removing fashion and thus converted into the desired plane-parallel target form, wherein the semiconductor wafers are guided in freely floating fashion and without fixed clamping onto a reference chuck in the processing apparatus. Freely floating double-side group processing methods of this type can be implemented as grinding, lapping and polishing methods.

In this case, both sides of a plurality of semiconductor wafers are simultaneously processed in material-removing fashion between two large ringed-shaped working disks. For this purpose, the semiconductor wafers are individually inserted into receptacle openings in a plurality of thin guide cages. The guide cages are also referred to as carriers and have an outer toothing. The toothing engages into a drive ring ("sun gear") arranged within the inner circumference of the ring-shaped working disks and a drive ring ("internal gear") arranged outside the outer circumference of the ring-shaped working disks. As a result of the rotation of working disks, sun gear and internal gear, the carriers and hence the semiconductor wafers describe cycloidal trajectories over the working disks. This arrangement, known as "planetary gearing", leads to particularly uniform, isotropic and regular processing of the semiconductor wafers.

In the case of lapping, a slurry composed of loose solids having an abrasive action (lapping grain) in a usually oily, glycol-containing or aqueous carrier liquid is supplied to the working gap formed between the working disks, the carriers with the semiconductor wafers moving in said working gap. The working disks contain no substances having an abrasive action in their regions coming into contact with the semiconductor wafers. The material removal is effected by relative movement between working disks and semiconductor wafers under pressure and with the addition of this slurry, also called "lapping slurry".

In the case of double-side polishing, the working surfaces of the working disks that face the semiconductor wafers are in each case covered with a polishing pad. The working gap, in which the semiconductor wafers move, is thus formed between the polishing pads. Instead of a lapping agent, a polishing agent is fed to said working gap. This is generally an aqueous colloidal dispersion of silica sol having a pH value of between 10 and 13. In this case, the polishing pad contains no abrasive substances that bring about material removal.

In the case of double-side grinding with planetary kinematics, the working surfaces of the working disks that face the workpieces each comprise a working layer having fixedly bonded abrasive substances that engage with the workpieces. A cooling lubricant containing no abrasive substances that bring about mechanical material removal is supplied to the working gap formed between the working layers. The working layer can be a grinding pad which is connected to the working disk by means of adhesive bonding, magnetically, by means of vacuum or in a positively locking manner (e.g. by means of a hook and loop fastener) and can be removed by means of a peeling movement. The abrasive grain fixedly bonded into the grinding pad is preferably diamond, alternatively also silicon carbide (SiC), boron nitride (cubic boron nitride, CBN), boron carbide (B4C), zirconium oxide (ZrO2), aluminum oxide (Al2O3) or mixtures of the materials mentioned. The working layers can also be composed of a multiplicity of stiff grinding bodies containing abrasive substances. Alternatively, the working disks themselves can be embodied as grindstones, i.e. themselves contain abrasive substances, such that no further covering with grinding pads or grinding bodies is required. The cooling lubricant supplied to the working gap is preferably pure water, optionally also with additions of viscosity-changing agents (glycols, hydrocolloids) or agents that chemically support material removal (pH>10). Double-side grinding with planetary kinematics is described for example in DE102007013058A1, an apparatus suitable therefor is described for example in DE19937784A1, suitable grinding pads are disclosed for example in U.S. Pat. No. 5,958,794 and suitable carriers are disclosed for example in DE1020070498A1.

So-called orbital grinding is additionally known, wherein the semiconductor wafers are inserted into a single guide cage, which covers the entire circular (not ring-shaped!) working disk and is driven to effect a gyroscopic movement by means of eccentrics fitted outside the working disks. The method is described for example in US2009/0311863A1.

All of the methods mentioned are intended to lead to semiconductor wafers having a particularly uniform thickness (parallelism of front and rear sides of the semiconductor wafers) and flatness (planarity of front and rear sides). Moreover, the thickness deviations from semiconductor wafer to semiconductor wafer, from batch to batch and between the actual value (actual thickness after processing) and the desired value (target thickness) are intended to be as small as possible. It has been found that comparatively large deviations from batch to batch and between the actual thickness and the target thickness occur in particular in the double-side grinding methods. These deviations can be compensated for only by increased material removal by means of the subsequent steps (double-side polishing) which, on account of the small damage depth of the ground semiconductor wafers, actually manage with very little material removal, such that the process times during double-side polishing are lengthened unnecessarily.

SUMMARY

In an embodiment, the present invention provides a method of a simultaneous double-side material-removing process of at least three workpieces includes disposing the workpieces in a working gap between rotating upper and lower working disks of a double-side processing apparatus. The workpieces lie in freely movable fashion in respective openings in a guide cage and are moved under pressure in the working gap using the guide cage. Upon attaining a preselected target thickness of the workpieces, a deceleration process is initiated that includes reducing an angular velocity $\omega_i(t)$ of a respective drive i of each of the upper working disk, lower working disk and guide cage to a standstill. The reducing is carried out such that ratios of the angular velocities $\omega_i(t)$ with respect to one another as a function of time t deviate by no more than 10% from initial ratios of the angular velocities $\omega_i(t)$ corresponding to when the preselected target thickness was attained.

BRIEF DESCRIPTION OF THE DRAWINGS

Exemplary embodiments of the present invention are described in more detail below with reference to the drawings, in which.

Figure 1:
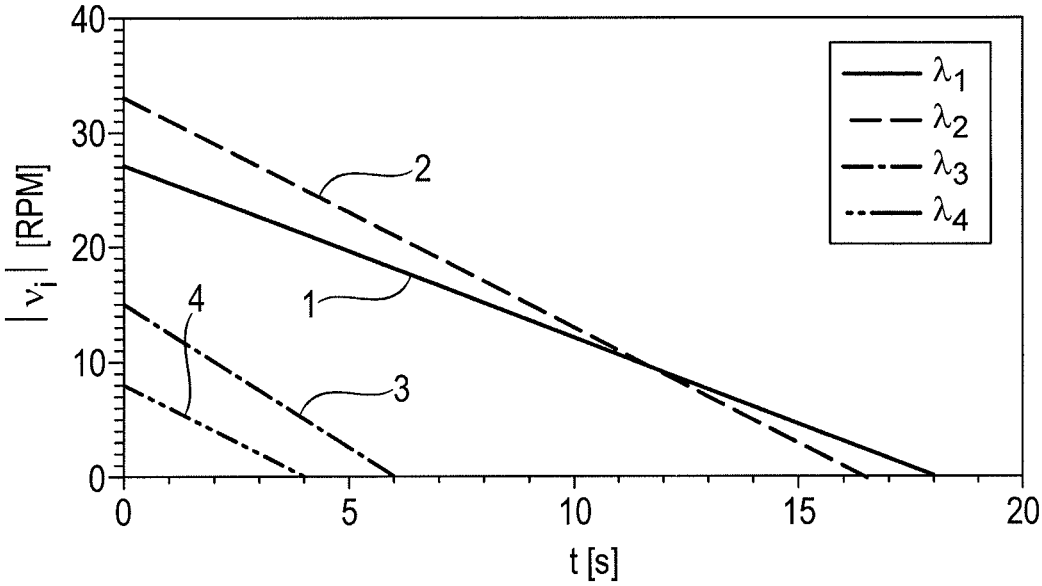
FIG. 1(A) shows rotational speeds of the main drives for a method not according to the invention with a linear deceleration process.
FIG. 1(B) shows rotational speeds of the main drives for a method according to the invention with a linear deceleration process.
Figure 1:
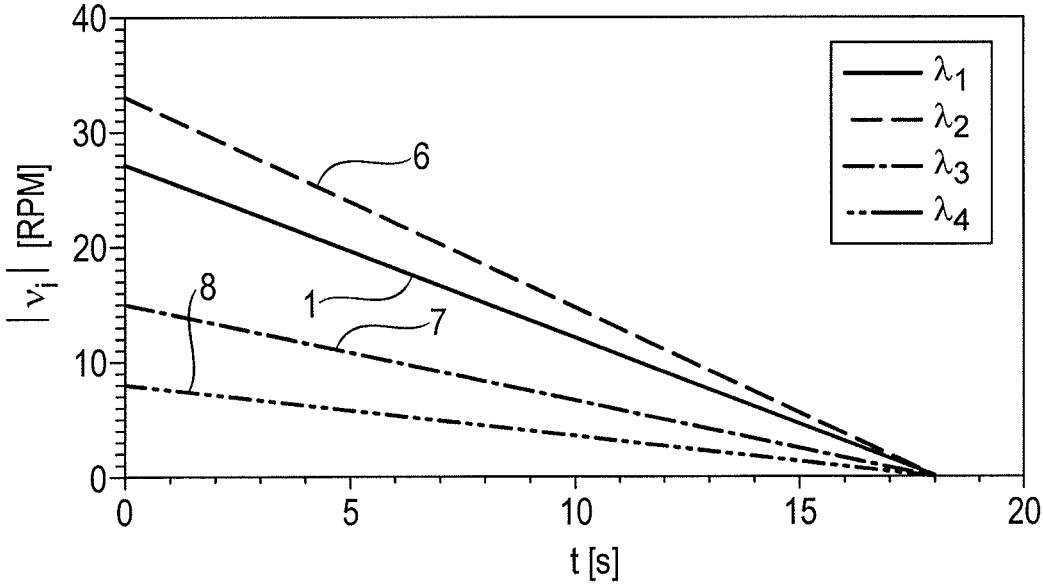

LIST OF REFERENCE SYMBOLS AND ABBREVIATIONS 1 linear deceleration of the upper working disk where $\nu_{1,0}$=27 1/min and $\lambda_1=\dot{\nu}_1$=−1.5 1/min·s 2 linear deceleration of the lower working disk where $\nu_{2,0}$=33 1/min and $\lambda_2=\dot{\nu}_2$=−2 1/min·s 3 linear deceleration of the inner drive ring where $\nu_{3,0}$=15 1/min and $\lambda_3=\dot{\nu}_3$=−2.5 1/min·s 4 linear deceleration of the outer drive ring where $\nu_{4,0}$=8 1/min and $\lambda_4=\dot{\nu}_4$=−2 1/min·s 5 linear deceleration of the lower working disk where $\nu_{2,0}$=33 1/min and $\lambda_2=\dot{\nu}_2$=−1.833 1/min·s 6 linear deceleration of the inner drive ring where $\nu_{3,0}$=15 1/min min and $\lambda_3=\dot{\nu}_3$=−0.833 1/min·s 7 linear deceleration of the outer drive ring where $\nu_{4,0}$=8 1/min and $\lambda_4=\dot{\nu}_4$=−0.444 1/min·s 8 progressive deceleration of the upper working disk where $\nu_{1,0}$=27 1/min and $\rho_1=\dot{\nu}_1$=−1.5 1/min·s (root characteristic)

9 progressive deceleration of the lower working disk where $\nu_{2,0}$=33 1/min and $\rho_2=\dot{\nu}_2$=−2 1/min·s (root characteristic)

10 progressive deceleration of the inner drive ring where $\nu_{3,0}$=15 1/min and $\rho_3=\dot{\nu}_3$=−2.5 1/min·s (root characteristic)

11 progressive deceleration of the outer drive ring where $\nu_{4,0}$=8 1/min and $\rho_4=\dot{\nu}_4$=−2.5 1/min·s (root characteristic)

12 progressive deceleration of the lower working disk where $\nu_{2,0}$=33 1/min and $\rho_2=\dot{\nu}_2$=−1.833 1/min·s (root characteristic)

13 progressive deceleration of the inner drive ring where $\nu_{3,0}$=15 1/min and $\rho_3=\dot{\nu}_3$=−1.5 1/min·s (root characteristic)

14 progressive deceleration of the outer drive ring where $\nu_{4,0}$=8 1/min and $\rho_4=\dot{\nu}_4$=−1.5 1/min·s (root characteristic)

$\omega_i$ (omega) angular velocity of the drive i $|\omega_i|$ magnitude of the angular velocity of the drive i $\omega_{i,0}$ angular velocity of the drive i at the beginning of the deceleration process (instant t=0), $\omega_{i,0}=\omega_i(t=0)$ $\dot{\omega}_i$ time derivative of the angular velocity of the drive i, $$\dot{\omega}_i = \frac{d}{dt}\omega_i$$

$\nu_i$ (ny) rotational speed of the drive i, $$\nu_i = \frac{1}{2\pi}\omega_i$$

$\dot{\nu}_i$ time derivative of the rotational speed of the drive i in units $$\frac{1}{s^2}, \frac{1}{\text{min}^2} \text{ or } \frac{1}{\text{min}\cdot s}, \dot{\nu}_i = \frac{d}{dt}\nu_i$$

$\lambda_i$ decrease in rotational speed of the drive i with linear deceleration (λ (lambda)="linear" characteristic), $$\lambda_i = \dot{\nu}_i = \frac{d}{dt}\nu_i$$

$\rho_i$ decrease in rotational speed of the drive i with progressive deceleration (ρ (rho)="root", as an example of progressive deceleration with root characteristic), $$\rho_i = \dot{\nu}_i = \frac{d}{dt}\nu_i$$

RPM rotations per minute (1/min)

t time

DETAILED DESCRIPTION

The present invention relates to a method for the simultaneous double-side material-removing processing of at least three workpieces between a rotating upper working disk and a rotating lower working disk of a double-side processing apparatus. The workpieces lie in freely movable fashion in a respective opening in a guide cage and are moved by the latter under pressure in a working gap formed between the two working disks. Upon a preselected target thickness of the workpieces being attained, a deceleration process is initiated, during which the angular velocities $\omega_i(t)$ of all the drives i of the upper working disk, of the lower working disk and of the guide cage are reduced to a standstill of the two working disks and of the guide cage.

In an embodiment, the present invention improves the known double-side group processing methods, and in particular the corresponding grinding method, such that the thickness deviations from batch to batch and between the actual and desired values are reduced. In this case, the small thickness deviations from workpiece to workpiece and within a workpiece (plane-parallelism of the two surfaces) and also the good flatness of the workpiece which are obtained in accordance with the prior art must be maintained.

In an embodiment, the present invention provides a method for the simultaneous double-side material-removing processing of at least three workpieces between a rotating upper working disk and a rotating lower working disk of a double-side processing apparatus, wherein the workpieces lie in freely movable fashion in a respective opening in a guide cage and are moved by the latter under pressure in a working gap formed between the two working disks, wherein, upon a preselected target thickness of the workpieces being attained, a deceleration process is initiated, during which the angular velocities ωi(t) of all the drives i of the upper working disk, of the lower working disk and of the guide cage are reduced to a standstill of the two working disks and of the guide cage, wherein the angular velocities $\omega_i(t)$ of all the drives i are reduced in such a way that, during the deceleration phase, the ratios of all the angular velocities $\omega_i(t)$ to one another as a function of the time t deviate by not more than 10% and preferably by not more than 5% from the ratios at the instant at which the preselected target thickness is attained.

In this case, it is possible to reduce the angular velocities $\omega_i(t)$ of the drives i during the deceleration process in accordance with the formula $$\omega_i(t) = \omega_{i,0} - \frac{k_i}{J_i}t,$$

i.e. linearly with time.

However, it is preferred for the magnitude of the change in the angular velocity $\omega_i(t)$ of each drive i per unit time to increase in the course of the deceleration process. This is preferably achieved by reducing the angular velocity $\omega_i(t)$ of each drive i in accordance with the formula $$\omega_i(t) = \sqrt{\omega_{i,0}^2 - \frac{2k_i}{J_i}t}\,.$$

In this case, $\omega_{i,0}$ denotes the angular velocity at the beginning of the deceleration process, $J_i$ denotes the moment of inertia where $J_i=\int\rho_i(\tau)r^2d\tau$, $\rho_i(\tau)$ denotes the density distribution, r denotes the distance from the axis of rotation, $k_i$ denotes a deceleration capacity of the drive i, dτ denotes an infinitesimal element of the volume τ that encompasses the rotating parts of the drive i, and t denotes the time.

In this case, the required deceleration capacity $k_i$ results as $$k_i = \frac{J_i\omega_{i,0}}{2t_{br}}$$

if an angular velocity $\omega_{i,0}$ at the beginning of the deceleration process and a time duration $t_{br}$ from the beginning of the deceleration until all the drives are at a standstill are predefined.

The duration $t_{br}$ of the deceleration process is preferably determined by the drive i having the greatest angular momentum $L_i=J_i\omega_{i,0}$.

BRIEF DESCRIPTION OF THE FIGURES

Proceeding from the abovementioned requirements made of the thickness and plane-parallelism of semiconductor wafers according to a double-side group processing method, the following considerations led to the present invention:

A defined end thickness of the semiconductor wafer can be achieved, in principle, by means of a thickness measurement during processing and ending processing upon the target thickness being attained, or by means of precise knowledge of the material removal as a function of time and a corresponding definition of the processing duration.

What all the abovementioned double-side group processing methods have in common is that the thickness of the workpieces cannot be determined directly during material removal, since the freely floating workpieces are not accessible to direct probing or contactless measurement on account of the rotating working disks and the guide cages moving therein which hold the workpieces. As an alternative, therefore, outside the working gap, the distance between the two working disks is determined for example inductively, capacitively by means of strain gauges or in a similar manner. A contactless sensor that measures the distance between working disks according to the eddy current principle is described for example in DE3213252A1.

In the case of lapping and in the case of double-side polishing, it is possible to exploit the fact that the material removal from the workpiece and the wear of the working surface satisfy the known Preston formula (Preston, F., J. Soc. Glass Technol. 11 (1927), 214-256) to a great extent. This formula makes it possible to derive, from processing that has already been effected, a prediction for the processing duration required to attain a desired target thickness of the workpieces. In these methods, the desired target thickness can be attained relatively well through the choice of processing duration.

However, the material removal during grinding does not satisfy the Preston formula: whereas during lapping or polishing the material removal is proportional to the velocity or pressure (straight line through the origin) over very wide ranges and in particular also for very low velocities or pressures, the grinding removal is extremely non-linearly dependent on pressure and velocity. This is known for example from Tönshoff et al., in: CIRP Annals—Manufacturing Technology, Vol. 41 (2), (1992) 677-688. During grinding, the dependence of material removal on velocity on pressure does not, in particular, represent a straight line through the origin. By way of example, a minimum pressure and a minimum velocity are necessary in order to bring about material removal.

Uniform workpiece thicknesses have to be attained not only during processing, that is to say in the case of rotating working disks, but in particular at the end of the processing process, that is to say in the case of resting working disks, when the processed workpieces can be unloaded. For this purpose, the working disks have to be stopped at the end of processing. The upper working disk of a double-side processing apparatus typically used for lapping, as is described for example in DE19937784B4, has a diameter of approximately 2 m and a moved mass of approximately 2000 kg. The upper working disk of a typical apparatus used for grinding or double-side polishing, as described for example in DE10007390A1, likewise has a diameter of approximately 2 m and a moved mass of up to 4500 kg.

Typical working rotational speeds of the double-side processing apparatuses used for lapping, grinding or polishing with a working disk diameter of approximately 2 m are approximately 30 rotations per minute (RPM). The working disks having the abovementioned typical dimensions, moved masses and typical angular velocities ω cannot be stopped without deceleration, owing to the high mass inertia and therefore high energy stored in the movement. In actual fact, the working disks can be decelerated to a standstill typically within approximately 10 seconds in the case of lapping and within approximately 30 seconds in the case of grinding or polishing, without the drives, the bearings thereof or else the entire machine frame of the processing apparatus being overloaded.

The pressure, too, with which the upper working disk loads the workpieces and the lower working disk during processing and thus brings about material removal from the workpieces during relative movement cannot be reduced arbitrarily rapidly. In the case of the methods mentioned, the typical processing pressures are always lower than the weight force of the upper working disk, for example between 750 and 1750 kg for a total of 15 semiconductor wafers having a diameter of 300 mm (five carriers each with three semiconductor wafers). The upper working disk therefore always bears on the workpieces with partial load relief during processing. In order to reduce the pressure, the working disk has to be subjected to further load relief. This is done hydraulically, pneumatically or by means of mechanical actuating apparatuses. The load relief (filling a hydraulic cylinder with working fluid; filling lifting bellows with air; application of force of a mechanical actuating apparatus) is associated with mass transports (working fluid, air, lever or plunger) and therefore likewise requires time, typically likewise approximately 10 seconds.

During the deceleration of the drives at the end of processing until all the drives are at a standstill (deceleration process), material continues to be removed. This material removal can be predicted very well for lapping and polishing on account of the Preston relationship of the resulting material removal rate, said Preston relationship being valid over a very large pressure and velocity range, with the result that the end thickness of the workpieces that can be expected when the drives are at a standstill is known very precisely. The processing process can accordingly be ended earlier and the deceleration of the drives can be initiated, such that at standstill the desired target thickness can actually be attained with only a small deviation.

Moreover, the material removal rates are relatively low during polishing and during lapping, and they decrease further during the deceleration process in accordance with Preston proportionally to instantaneous pressure and instantaneous path velocity. During polishing, typical removal rates of 0.2 to 0.3 nm/min occur at nominal rotational speed. In the case of a duration of the deceleration process of 30 seconds (0.5 minute), the so-called "after-polishing", that is to say the additional material removal during the deceleration process, is accordingly only approximately 60 nm (nanometers) if the drives are brought to a standstill with a constant deceleration of their rotational speeds.

During lapping, the removal rates are between 2.5 and 7.5 μm/min, and only approximately 2 μm/min for particularly gentle lapping processes using fine grain. For semiconductor wafers lapped using fine grain, the so-called "after-lapping" during the deceleration process is only approximately 160 nm. This is a small amount comparable to the typical 60 nm after-polishing in the case of polishing, since an increased material removal is required anyway during the polishing required after fine lapping, such that somewhat more greatly fluctuating initial thicknesses can be afforded tolerance. Semiconductor wafers lapped using coarser grain undergo an etching treatment anyway, which significantly impairs both the thickness constancy and plane-parallelism of the semiconductor wafers.

Double-side-ground semiconductor wafers have only small damage depths on account of the gentle grinding process, such that only a small polishing removal is subsequently necessary. In addition, water is preferably used as cooling lubricant during grinding, such that ground semiconductor wafers manage without complicated cleaning and in particular without additional etching that always brings about additional material removal and, consequently, also a dimensional change of the semiconductor wafers. Double-side-ground semiconductor wafers are therefore directly suitable for further processing in a subsequent polishing process that concludes the overall production process. Therefore, the ground semiconductor wafers have to have thickness distributions that are afforded particularly small tolerances for all the semiconductor wafers. On the other hand, material removal rates of greater than 20 μm/min are obtained during double-side grinding, such that several micrometers of material are still removed during the deceleration process. Since the material removal during grinding cannot be predicted using the Preston formula and, moreover, changes greatly depending on the present state of the grinding tool, the thickness variation of the processed workpieces in the case of grinding is particularly high—which cannot be reconciled with the particularly stringent requirements made of the thickness constancy of the ground workpieces.

An attempt could then be made to reduce the material removal effected during the deceleration process and hence the thickness fluctuations of the finished ground workpieces by all the drives being decelerated and brought to a standstill as rapidly as respectively possible, assuming that the thickness of the material which is still removed inadmittently during deceleration likewise becomes minimal as a result. Such methods for stopping all the drives as rapidly as possible are known as an emergency off function in the prior art. This function aims to minimize in the case of disturbance by bringing to a standstill as rapidly as possible all moved installation parts that cause danger to the installation operator.

US2001056544A describes, for example, a large number of methods as to how it is possible to bring movable installation components to a standstill by evaluating different sensors that detect different variables of the moved installation components and the state of the overall system in its environment.

Although rapid stop or emergency off systems known in the prior art can rapidly bring moved installation parts to a standstill and thereby reduce the duration and thus presumably also the magnitude of the undesired after-grinding, it has been found that semiconductor wafers ground by means of drives rapidly brought to rest in this way generally have very poor flatnesses. The advantage of the very good plane-parallelism of the processed semiconductor wafers would thereby be nullified, and additional, downstream material-removing processing steps would be necessary in order that the resultant poor flatness of the semiconductor wafers is improved again. This would lead to highly uneconomic overall processing.

The measures known in the prior art for rapidly stopping moved installation parts are therefore unsuitable for producing particularly flat semiconductor wafers that are dimensionally accurate in respect of target thicknesses.

Proceeding from this insight, extensive investigations were conducted in order to find out what conditions have to be met by a fast shutdown process in order simultaneously to achieve good flatness and good dimensional accuracy in respect of target thicknesses.

The grinding method was carried out on two commercially available double-side processing machines with planetary kinematics, an AC-2000 from Peter Wolters GmbH and a 32BF from Hamai Co., Ltd. The AC-2000 has two ring-shaped working disks having an external diameter of 1935 mm and an internal diameter of 563 mm, and the 32BF has two ring-shaped working disks having an external diameter of 2120 mm and an internal diameter of 740 mm. The AC-2000 can accommodate five carriers each with three semiconductor wafers having a diameter of 300 mm. Five carriers each with three semiconductor wafers having a diameter of 300 mm were used in the case of the 32BF, too. The openings for accommodating a respective semiconductor wafer having a diameter of 300 mm were used openings arranged on such a small pitch circle around the center of the carrier, such that the semiconductor wafers, exactly as on the AC-2000, during their movement on the working disk, did not project or projected only slightly (<10 mm) beyond the edge thereof As working layers, grinding pads from 3M of the 677XAEL type were adhesively bonded onto the working disks of both double-side processing apparatuses. Said pads contain diamond as an abrasive in bonded form. The grinding pads were trimmed by means of trimming disks on which sintered corundum grinding bodies are fixed. As a result, a working gap plane-parallel to a few micrometers across the radius was obtained between the mutually facing surfaces of the grinding pads that come into contact with the semiconductor wafers. As a result, prerequisites were provided for being able to produce, in principle, very good and—for all semiconductor wafers of a batch—identical thicknesses and parallelisms of their surfaces.

Double-side grinding by means of a grinding pad on a double-side processing machine with planetary kinematics is designated hereinafter as PPG method ("planetary pad grinding") for short.

Numerous grinding experiments were carried out with semiconductor wafers having an initial thickness of approximately 900 μm that were sliced from an Si(100) single crystal rod by means of wire separating lapping (wire sawing), calibrated to a diameter of 300 mm and subjected to edge rounding. As target thickness after processing by means of the PPG method, 825 μm was defined, which was intended to be achieved by all semiconductor wafers as precisely as possible, with a small thickness deviation and with good flatness (approximately 1 μm global flatness variation, TTV).

Both double-side processing apparatuses had four main drives adjustable independently of one another with respect to time and in terms of rotational speed (inner and outer drive rings, upper and lower working disks), for which additional parameters such as, for example, the applied load of the upper working disk (grinding pressure) and the supply of cooling lubricant could be chosen within a plurality of so-called load steps. In addition, both apparatuses had measuring means for measuring the distance between working disks. Since the grinding pad used was subjected only to very little wear from experiment pass to experiment pass, it was possible, after measuring the grinding pad thickness, to deduce very precisely from the measured distances between working disks the actual width of the working gap between the mutually facing working surfaces of the grinding pads and, consequently, the thickness of the semiconductor wafers.

With this experimental arrangement, given approximately 1000 daN (decanewtons) applied load of the upper working disk on the 15 semiconductor wafers having a diameter of 300 mm at approximately 30 RMP rotation of the working disks in opposite directions, in each pass removal rates of approximately 20 μm/min were obtained. Firstly, for an average duration tbr of the deceleration process until the main drives were at a standstill of approximately 20 seconds, an expected "after-grinding" (decrease in thickness of the semiconductor wafers during the deceleration process) of approximately 3.5 μm was estimated and was added as an allowance to the end switch-off value, upon the attainment of which the deceleration of the drives is to begin, in order that the target thickness of 825 μm with the drives at a standstill is achieved as well as possible.

It was found that the thicknesses of the semiconductor wafers that were actually obtained when the drives were stopped as rapidly as possible, without further measures, deviated from the target thickness by up to ±5 μm from pass to pass. Moreover, it emerged that even at low grinding pressures and rotational speeds, removal rates of a few micrometers per minute evidently still result in some instances, which explain these thickness deviations of significantly above the after-grinding estimated at 3.5 μm, and these were, moreover, greatly dependent on the employed deceleration characteristic of the individual drives. Within each pass, the average thicknesses of the individual semiconductor wafers were, as expected, very close to one another (<0.5 μm), which indicates that the variation of the initial thicknesses and the chosen material removal of 75 μm and the maintenance of a substantially uniformly plane-parallel form of the working gap over the total removal were sufficient and that the result of the PPG grinding experiments was not adversely affected by inadequacies of the initial semiconductor wafers.

It was particularly evident that, on account of the procedurally typically high average material removal rates during PPG grinding, also while a drive is coming to a stop, so much material is removed from the semiconductor wafers that not only was the target thickness missed by quite a few micrometers, but in particular also very poor plane-parallelisms (global thickness fluctuations of more than 5 micrometers) were obtained which, in addition, fluctuated greatly from pass to pass.

The fluctuations were particularly great when, in expectation of the least influence by virtue of a shortest possible total deceleration time of the drives, each drive was decelerated as rapidly as possible in each case. Such deceleration of all the drives to a standstill within the shortest possible time corresponds to the behavior of such an apparatus upon actuation of the emergency off switch. In this case, the drives of the drive rings were stationary after just a few seconds, the lower working disk after approximately 10 seconds, and the upper working disk having the highest mass after approximately 20 seconds. The resulting relative movements—bringing about material removal—of working disks and semiconductor wafers were in total the shortest possible here.

However, in this case, the grinding friction forces on the semiconductor wafers, said forces evidently resulting from the different deceleration times of the drives, proved in some instances, and in a manner fluctuating from pass to pass, to be so unbalanced that the resulting moments of friction exerted on the semiconductor wafers were so high that, in individual cases, semiconductor wafers or carriers were overloaded and the fracture of semiconductor wafers or the deformation of teeth of the outer toothing of the carriers occurred.

FIG. 1(A) shows, as a comparative example, the decrease in the rotational speeds $$\nu_i = \frac{1}{2\pi}\omega_i$$

of the drives i (i=1: upper working disk, curve 1; i=2: lower working disk, curve 2; i=3: inner drive ring, curve 3; i=4: outer drive ring, curve 4) during the deceleration process for a method not according to the invention. The rotational speeds $\nu_{1,0}$ of the drives i at the beginning of the deceleration process were, in this and in all following examples and comparative examples, $\nu_{1,0}$=27 RPM (upper working disk, 1), $\nu_{2,0}$=33 RPM (lower working disk, 2), $\nu_{3,0}$=15 RPM (inner drive ring, 3), $\nu_{4,0}$=8 RPM (outer drive ring, 4). Here and hereinafter, for reasons of clarity, only the magnitudes of the angular velocities, $|\omega_i|$, and of the rotational speeds, $|\nu_i|$, are indicated in each case.

Hereinafter, angular velocities $\omega_i$ and rotational speeds $\nu_i$ are used alongside one another; the angular velocities since they make it possible to represent the formal relationships more clearly, and the rotational speeds since they are customary in the formulation of the processing processes suitable for carrying out the invention and as a direct setting parameter of the apparatuses used. Angular velocities are generally vectors, $\vec{\omega}$, which point in the direction of the axis of rotation and have a length (magnitude) of $\omega=|\vec{\omega}|=2\pi\nu$. Since the axes of rotation of all the drives of the processing apparatuses considered here are collinear (no direction dependence), a complete description of the movement sequences can also be given in a simple manner just on the basis of the scalars (magnitudes of the vectors).

The comparative example shown in FIG. 1(A) corresponds to a deceleration of all the drives with—in a manner governed by the design—the highest possible deceleration at the beginning of the deceleration process, $\dot{\omega}_{i,0}=\dot{\omega}_i(t=0)$ (time origin chosen at start of deceleration), which is then maintained in a constant fashion during the entire deceleration process until the drives are at a standstill, $\omega_i(t)=\dot{\omega}_{i,0}$=const. In this case, the rotational speeds are regulated downward linearly with time, $$\lambda_i = \frac{d}{dt}\nu_i = \dot{\nu}_i = const$$

(time derivative of the rotational speeds remains constant). The case corresponds to the drives coming to a standstill upon activation of an emergency off shutdown at the instant t=0 s with a linear deceleration characteristic of the emergency shutdown.

On account of the different masses and, consequently, the rotational energy stored in a manner dependent on the rotational speed in the driven installation parts, the different drives can be decelerated at different rates $$\dot{\omega}_i = \frac{d}{dt}\omega_i$$

(time derivative of the angular velocity, deceleration); in the comparative example shown, the maximum deceleration rates for the drives were i=1 . . . 4: $\lambda_1=\dot{\nu}_1$=1.5 1/min·s, $\lambda_2$=2 1/min·s, $\lambda_3$=2.5 1/min·s, and $\lambda_4$=2 1/min·s. The unit 1/(min·s), which can readily be used in practice, means here that the angular velocity (in 1/min) is reduced within one second by the respectively indicated value (in 1/min) Depending on the deceleration rate and the initial rotational speed of the drives at the beginning of the deceleration process, the drives therefore generally come to a standstill at different speeds when using a deceleration process that is as rapid as possible. In particular, they can also "overtake" one another in general during the deceleration process: although the lower working disk at $\omega_{2,0}=2\pi\times33$ RPM (2) begins the deceleration process at higher angular velocity than the upper working disk at $\omega_{1,0}=2\pi\times27$ RPM (1), it comes to a standstill more rapidly, namely after approximately 16 seconds, than the upper working disk, which comes to a standstill after 18 seconds, since the lower working disk can be decelerated more rapidly, namely at $\dot{\nu}_2$=2 1/min·s, while the heavier upper working disk can only be decelerated at $\dot{\nu}_1$=1.5 1/min·s.

During this deceleration process at maximum speed, the semiconductor wafer experiences constantly over the deceleration time variable velocities relative to the grinding pads bringing about material removal. The removal behavior is difficult to predict, and the non-uniformity (anisotropy) with which the semiconductor wafer is moved relative to the grinding pads causes frequent load changes (reversal of the relative starting velocity), and semiconductor wafers having a very poor global flatness (TTV, total thickness variation) are obtained after all the drives are at a standstill (TTV up to 5 μm). In particular, semiconductor wafers processed in this way proved to be wedge-shaped, that is to say that they have a thickness gradient across one of their diameters. This indicates that the semiconductor wafer did not rotate in an undisturbed manner and uniformly (statistically) in its receptacle opening in the carrier during the deceleration process.

The temporal change $\dot{\vec{L}}_i$ in in the angular momentum $\vec{L}_i$ of the installation part i as a result of the action of a torque $\vec{M}_i$ is described by the relationship $\vec{M}_i=\dot{\vec{L}}_i=J_i\cdot\dot{\omega}_i$. In this case, the torque $\vec{L}_i=J_i\cdot\vec{\omega}_i$, where $\vec{\omega}_i$ denotes the vector of the angular velocity with the magnitude $\omega_i=|\vec{\omega}_i|=2\pi\nu_i$ of the installation part i with the rotational speed $\nu_i$ in 1/s or 1/min. In this case, $J_i$ is the moment of inertia of the rotating installation part i, which has a mass $m_i=\int\rho_i(\tau)d\tau$, where $J_i=\int\rho_i(\tau)\cdot r^2\cdot d\tau$, where $\rho_i(\tau)$ denotes the density of the installation part i in the volume element τ, r denotes the distance between the volume element and the rotational axis and $\int\ldots d\tau$ denotes the integration over all volume elements τ that the installation part comprises. The actual highest possible deceleration rates for deceleration of the drives as rapidly as possible result in practice from the fact that the torque $\vec{M}_i$ applied during deceleration is limited to the drive i rotating at angular momentum $\vec{L}_i$. In the event of the maximum torque $\vec{M}_i$, being exceeded, components of the apparatus would be overloaded. By way of example, the bearing arrangement for the axis of rotation of the drive i or even the machine frame of the entire processing apparatus, particularly in the event of excessively rapid deceleration of the particularly solid and heavy working disks, can permanently deform plastically or even fail (break).

FIG. 1(B) shows an example of a method according to the invention wherein the drives, as in the comparative example in accordance with FIG. 1(A), were decelerated likewise linearly, but now such that the rotational speeds of two arbitrary different drives always had the same ratio at every point in time in the deceleration process. The total duration of the deceleration process that is at least required for this purpose is determined by the drive i having the highest rotational energy $$E_i = \frac{1}{2} J_i \omega_{i,0}^2,$$

that is to say from its moment of inertia $J_i$ (and thus the maximum possible deceleration rate $\dot{\omega}_i$) and its angular velocity at the beginning of the deceleration process, $\omega_{i,0}$. In the example shown in FIG. 1(B), the upper working disk has the highest angular momentum, which thus determines the fastest possible deceleration process according to the invention. According to the invention, the drives are then decelerated during the deceleration process in each case precisely such that the ratio of the instantaneous angular velocities of two arbitrary drives, where $$\frac{\omega_i(t)}{\omega_j(t)}$$

where i≠j, is constant at every point in time, that is to say $$\frac{\omega_i(t)}{\omega_j(t)} := const.$$

The condition $$\frac{\omega_i(t)}{\omega_j(t)} := const$$

can be fulfilled as follows:

$$\frac{\omega_i(t)}{\omega_j(t)} = const. \Leftrightarrow \frac{d}{dt}\left(\frac{\omega_i(t)}{\omega_j(t)}\right) = \frac{\dot{\omega}_i}{\omega_{j,0}} - \frac{\omega_{i,0}\dot{\omega}_j}{\omega_{j,0}^2} \overset{!}{=} 0 \Leftrightarrow \frac{\dot{\omega}_i}{\omega_j} = \frac{\omega_{i,0}\dot{\omega}_j}{\omega_{j,0}^2} \Leftrightarrow \frac{\dot{\omega}_i}{\dot{\omega}} = \frac{\omega_{i,0}}{\omega_{j,0}},$$

that is to say $$\frac{\dot{\omega}_i}{\omega_{j,0}} - \frac{\omega_{i,0}\dot{\omega}_j}{\omega_{j,0}^2} = 0 \Leftrightarrow \frac{\dot{\omega}_i}{\omega_j} = \frac{\omega_{i,0}\dot{\omega}_j}{\omega_{j,0}^2} \Leftrightarrow \frac{\dot{\omega}_i}{\dot{\omega}} = \frac{\omega_{i,0}}{\omega_{j,0}};$$

i.e. the ratio of the deceleration rates of two different drives i and j, $$\frac{\dot{\omega}_i}{\dot{\omega}_j},$$

is chosen such that it corresponds exactly to the ratio $$\frac{\omega_{i,0}}{\omega_{j,0}}$$

of the initial angular velocities $\omega_{i,0}$ and $\omega_{j,0}$ at the beginning of the deceleration process, $$\frac{\dot{\omega}_i}{\dot{\omega}_j} = \frac{\omega_{i,0}}{\omega_{j,0}}.$$

In the example shown in FIG. 1(B), the angular velocities at the beginning of the deceleration process were again $\omega_{i,0}=2\pi\times27$ RPM (upper working disk, 1), $\omega_{2,0}=2\pi\times33$ RPM (lower working disk, 5), $\omega_{3,0}=2\pi\times15$ RPM (inner drive ring, 6), $\omega_{4,0}=8$ RPM (outer drive ring, 7), and the decelerations were chosen as $\dot{v}_1=1.5$ 1/mm·s (gradient of the deceleration curve 1), $\dot{v}_2=1.833$ 1/min·s (gradient of curve 2), $\dot{v}_3=0.833$ 1/mm·s (gradient of curve 3), and $\dot{v}_4=0.444$ 1/min·s, (gradient of curve 4). In order to confirm that the deceleration in the example shown in FIG. 1(B) was actually carried out with a ratio of the angular velocities of the drives that is constant according to the invention, $$\frac{\dot{\omega}_1}{\dot{\omega}_2} = \frac{1.5}{1.833} = 0.818 = \frac{\omega_{1,0}}{\omega_{2,0}} = 27/33 = 0.818$$

etc. is checked for all the drives i≠j.

In this method carried out according to the invention, the workpieces, at every point in time during the deceleration of the drives, always experience the same constant kinematics as present at the instant when the shutdown target thickness is attained (beginning of the deceleration process). Very good flatnesses with on average a TTV<1 μm were obtained, and the fluctuation Δd of the average thickness d of all the workpieces of one pass from the average value of all the workpieces of all the passes was very small with |Δd|≤1 μm.

It was found, then, in the investigations concerning the deceleration behavior of the drives and the resultant thickness fluctuations of the workpieces from pass to pass and the flatnesses (geometries) that the drives can even be brought to a standstill significantly more rapidly than with the above-described linear deceleration of their rotational speeds, without the installation being damaged or the drives that supply the rotating machine parts and have to absorb energy arising during deceleration being overloaded, and that this deceleration can nevertheless be chosen such that the ratio of the rotational speeds of two arbitrary drives is always constant at any time in the deceleration process.

A drive i rotating at angular velocity $\omega_i$ and having a moment of inertia $J_i$ has the rotational energy $$E_{rot} = \frac{1}{2} J_i \omega^2.$$

During deceleration, the energy Erot is reduced at a rate $\dot{E}_{rot}=-P_{rot}$, where −Prot denotes the braking power. This braking power has to be absorbed by the drives, for example by the inverters, which drive the rotating installation parts and which are operated as generators during deceleration of the drives and feed this braking energy back into the power supply system, or by thermal conversion of the electrical power for example at a braking resistor. If the energy conversion takes place with constant power, drives and converting units (inverters, resistors) are subject to a constant loading. Since this loading (power) is constant, its (constant) maximum value for a given rotational energy to be reduced overall is also minimal at the same time. Such rapid deceleration is therefore particularly gentle for the processing apparatus.

From $P=-\dot{E}=-d/dt(\frac{1}{2}J_i\omega_i^2)=-J_i\omega_i\dot{\omega}=\text{const}:=k_i$, it follows that $$\dot{\omega}_i = -\frac{k_i}{J_1\omega},$$

i.e. the deceleration $\dot{\omega}_i$ for this purpose has to be chosen to be at any time precisely inversely proportional to the instantaneous angular velocity $\omega_i=\omega_i(t)$ of the drive i. (In this case, the dot above a term denotes once again the differentiation of the term with respect to time.)

Integration yields the relationship with which the angular velocity $\omega_i=\omega_i(t)$ has to depend on time t in order to meet this condition:

$$\int \omega_i\dot{\omega}_i dt = \int \omega_i \frac{d\omega}{dt} dt = \int \omega_i d\omega = 1/2\omega_i^2 + const.$$

The integration constant that occurs when solving the indefinite integral is determined from the initial conditions, $\omega_i(t=0)=\omega_{i,0}$, i.e. the angular velocity $\omega_{i,0}$ of the drive i at the instant t=0, at which the workpieces attained the target thickness for initiating the deceleration process of the drives, and thus results as $\text{const}=\omega_{i,0}^2$. Consequently $$\omega_i(t) = \sqrt{\omega_{i,0}^2 - \frac{2k_i}{J_i}t}. \tag{2}$$

The time tbr required for this until the standstill $\omega_i(t)=0$ is obtained as $$t_{br} = \frac{J_1\omega_{i,0}^2}{2k_i}.$$

This is only half as long as would be needed by braking with a constant deceleration (linear deceleration $$\omega_{lin}(t) = \omega_{i,0} - \frac{k_i}{J_i\omega_{i,0}}t)$$

with the same value $$-\frac{k_i}{J_i\omega_{i,0}}$$

of the initial deceleration as in the case of progressive braking according to equation (2), $$\omega_i(t) = \sqrt{\omega_{i,0}^2 - \frac{2k_i}{J_i}t}, \; t_{i,br,lin} = \frac{J_i\omega_{i,0}^2}{k_i} = 2t_{i,br,progr} = 2\frac{J_i\omega_{i,0}^2}{2k_i}.$$

Figure 2:
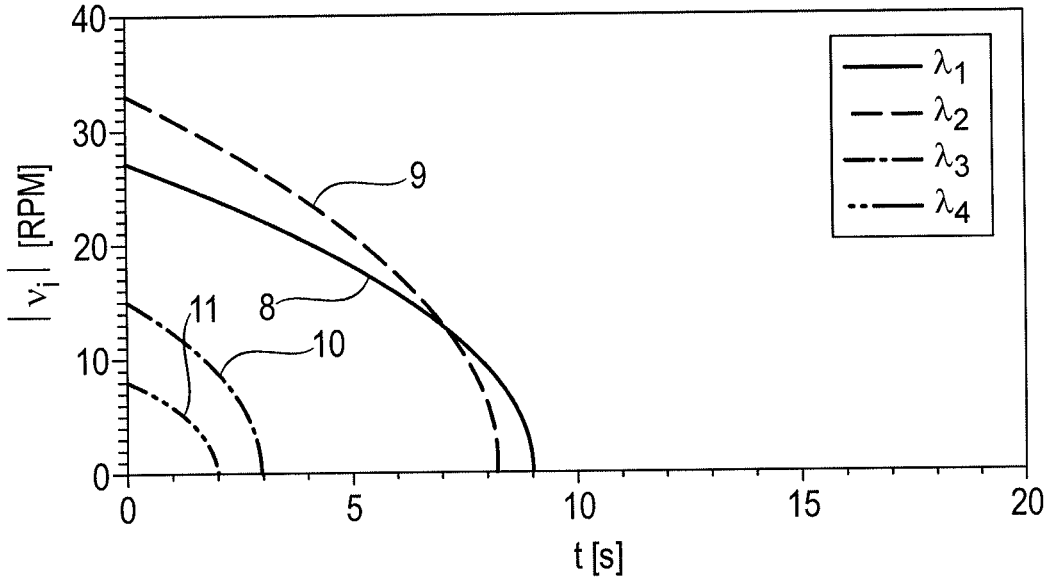
FIG. 2(A) shows rotational speeds of the main drives for a method not according to the invention with a progressive deceleration process.
FIG. 2(B) shows rotational speeds of the main drives for a method according to the invention with a progressive deceleration process.
Figure 2:
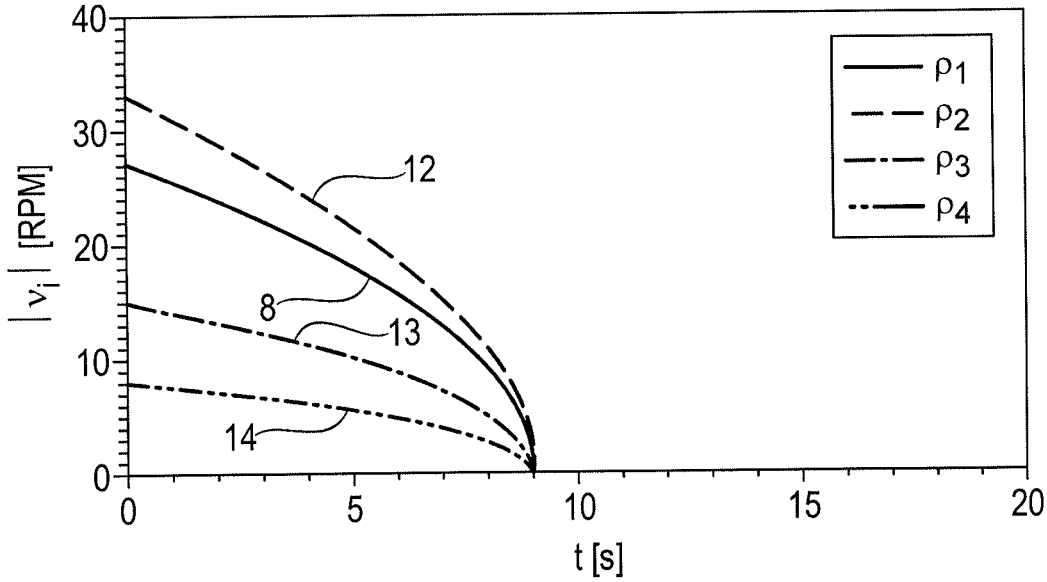

FIG. 2(A) shows, as a comparative example, deceleration not according to the invention, wherein all the drives i are decelerated at the same initial deceleration rate $\dot{\omega}_i(t=0)$ at the beginning of the deceleration process, t=0, from their initial angular velocity $\omega_{i,0}$. In this case, $\omega_{i,0}$ and $\dot{\omega}_i(t=0)$ were chosen identically to those from the comparative example in accordance with FIG. 1(A) with linear deceleration: $\omega_{i,0}=2\pi\times 27$ RPM (upper working disk, curve 8), $\omega_{2,0}=2\pi\times 33$ RPM (lower working disk, 9), $\omega_{3,0}=2\pi\times 15$ RPM (inner drive ring, 10), $\omega_{4,0}=\pi\times 8$ RPM (outer drive ring, 11); $\dot{v}_1(t=0)=^{1.5}\ ^{1}/\text{min}\cdot\text{s}$, $\dot{v}_2(t=0)=2$ 1/min·s, $\dot{v}_3(t=0)=2.5$ 1/min·s, $\dot{v}_4(t=0)=2$ 1/min·s.

Despite the halved time—compared with the comparative example in accordance with FIG. 1(A) (linear deceleration)—until the respective drives are at a standstill in FIG. 2(A) (progressive deceleration) and the therefore obvious supposition of a correspondingly reduced "after-grinding", poor results are obtained: although the average deviation of the average thicknesses of all the semiconductor wafers of one pass is only approximately 3 . . . 4 μm from the average thickness of all the semiconductor wafers of a plurality of passes, the flatness of the semiconductor wafers thus obtained, with a TTV of up to 5 μm, is just as poor as in the comparative example in accordance with FIG. 1(A).

Finally, FIG. 2(B) shows the deceleration curves of the drives for an example obtained with a deceleration method according to the invention, wherein the decelerations were chosen such that all the drives came to a standstill at the same time. In this case, the drive i=1 (upper working disk, curve 8), having the highest mass ml, the highest moment of inertia $J_i$ and thus the lowest fastest possible initial deceleration rate $\dot{v}_1(t=0)=1.5$ 1/min·s, once again determined the total duration of the deceleration process. With initial decelerations chosen as in the example in accordance with FIG. 1(B) at the instant of the initiation of the deceleration process of $\dot{v}_1(t=0)=1.5$ 1/min·s (gradient of the deceleration curve 8), $\dot{v}_2(t=0)=1.833$ 1/min·s (gradient of curve 12), $\dot{v}_3(t=0)=0.833$ 1/min·s (gradient of curve 13) and) $\dot{v}_4(t=0)=0.444$ 1/min·s (gradient of curve 14), in accordance with FIG. 2(B) the resulting duration of the deceleration process until the drives are at a standstill is only half as long as the duration in comparison with FIG. 1(B).

Figure 3:
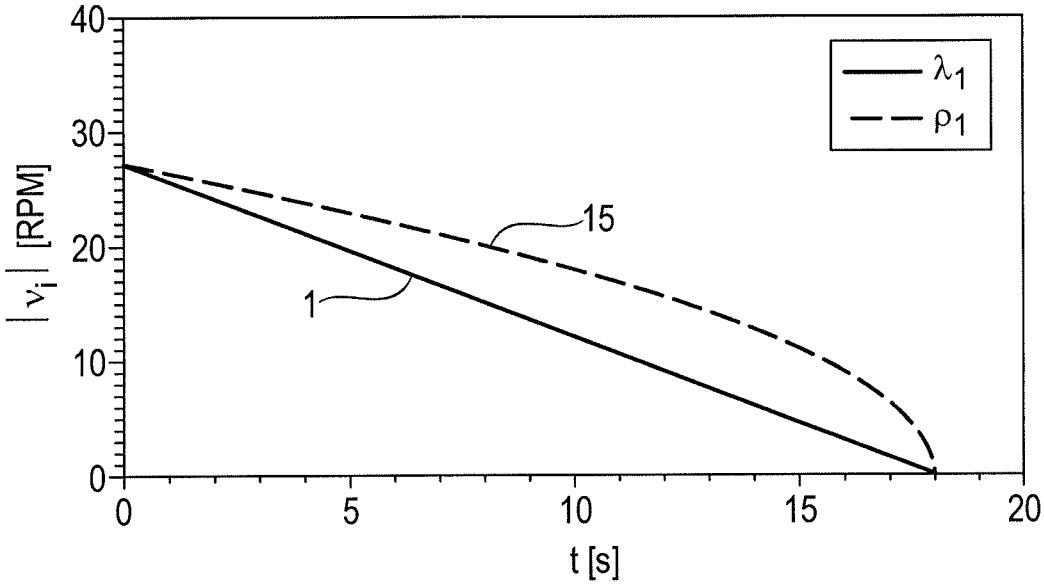
FIG. 3(A) shows rotational speeds of a main drive with a linear deceleration process and a progressive deceleration process having an identical duration until standstill, in comparison.
FIG. 3(B) shows rotational speeds of a main drive with a linear deceleration process and a shorter progressive deceleration process with the same deceleration constant.
Figure 3:
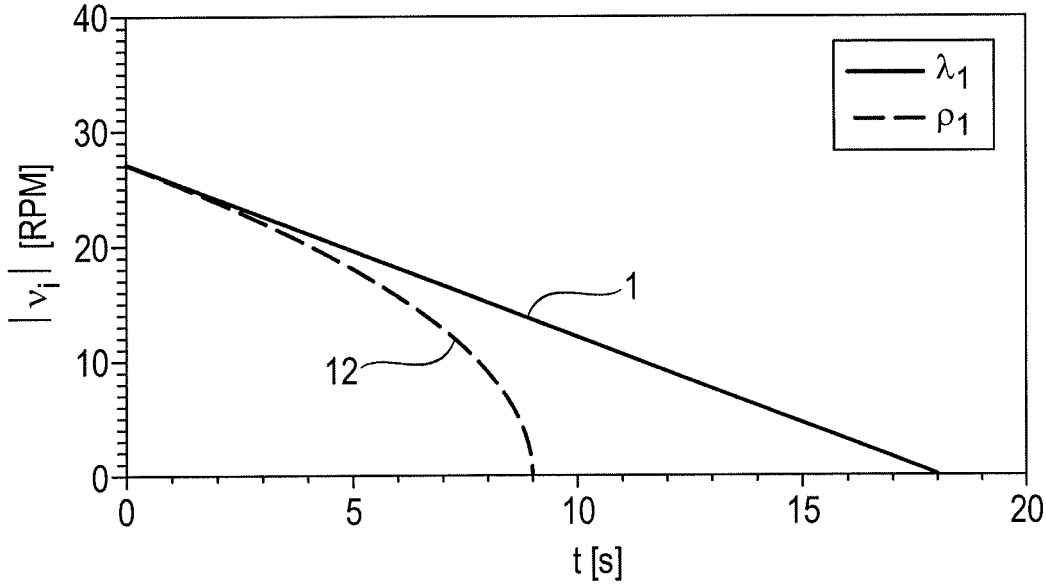

This is shown in FIG. 3(B) on the basis of the example of the drive i=1 (upper working disk) where $\omega_{i,0}=2\pi\times 27$ RPM and $\rho_1=\dot{v}_1(t=0)=1.5$ 1/min·s (progressive braking, deceleration curve 12) $\omega_{i,0}=\pi\times 27$ RPM and $\lambda_1=\dot{v}_1(t=0)=1.5$ 1/min·s (linear deceleration, curve 1). Conversely, the progressive braking also makes it possible to achieve a duration of the deceleration process until the drives are at a standstill which is the same as that with linear deceleration, with initial deceleration halved by comparison with linear deceleration. This has the advantage of being particularly gentle for the drive guides (spindles) loaded by the braking torque and the rest of the construction elements of the processing apparatus with regard to irreversible deformation or overloading. This is shown in FIG. 3(A), once again on the basis of the example of the drive i=1 (upper working disk) where $\omega_{i,0}=2\pi\times27$ RPM and $\rho_1=\dot{v}_1(t=0)=0.75$ 1/min·s (progressive braking, deceleration curve 15) in comparison with $\omega_{i,0}=\pi\times27$ RPM and $\lambda_1=\dot{v}_1(t=0)=1.5$ 1/min·s (linear deceleration, curve 1). Particularly good flatnesses (TTV<1 μm, in part even significantly below this value) and thickness fluctuations (|Δd|<1 nm) were obtained in this case.

In further investigations it was found that the object on which the invention is based is also achieved by those methods in which the deceleration was carried out only with substantially constant ratios of the angular velocities of the drives with respect to one another, i.e. it was found to be permissible for the ratios of the angular velocities to be subject to certain fluctuations in order nevertheless to obtain, according to the invention, end thicknesses of the workpieces with very little fluctuation from pass to pass. This is of importance since, in practice, exactly constant rotational speed ratios at any time can be realized only with very great difficulty. Since the drives of the processing apparatuses suitable for carrying out the invention have to apply high powers of, in general, a few kW (kilowatts) in order to overcome the process forces (grinding forces, grinding friction) occurring during processing, they cannot be embodied as stepper motors (low-power drives), with which exactly constant rotational speed ratios would be able to be realized, but rather generally have to be embodied as AC servomotors (power drives).

Servomotors achieve their desired rotational speeds by means of a closed-loop control. In this case, during operation, the deviation of the actual angular velocity $\omega_{i,ACTUAL}(t)$ from the desired angular velocity $\omega_{i,DESIRED}(t)$ is continuously measured and, in accordance with this control deviation, a force control unit feeds power to the drives (increase in rotational speed, acceleration) or takes power away from them (reduction in rotational speed, deceleration). Such a closed-loop control is necessary since the drives are subject to certain alternating loads during material-removing processing (instantaneous cutting capacity of the grinding tool subject to constant change owing to wear, temperature-dependent frictions, thermally governed shape and force introduction changes, etc.), which have to be compensated for.

It was then found still to be sufficient, in order to obtain end thicknesses of the workpieces that fluctuation little from pass to pass according to the invention, if the actual instantaneous ratios of the angular velocities during deceleration deviated by up to 10% from the desired constant target ratios. In this case, it was found to be unimportant whether the drives had a deviation upward (actual rotational speed>desired rotational speed) or a deviation downward (actual rotational speed<desired rotational speed), as long as the actual ratios $\omega_{i,ACTUAL}(t)/\omega_{j,DESIRED}(t)$ resulting from the actual angular velocities $\omega_{i,ACTUAL}(t)$ deviated in each case by not more than up to 10% from the ratios at the instant of the beginning of the deceleration process, $\omega_{i,0}/\omega_{j,0}=\omega_j(t=0)/\omega_j(t=0)$;

$$\left|\frac{\omega_{i,ACTUAL}(t)}{\omega_{j,ACTUAL}(t)}-\frac{\omega_{i,0}}{\omega_{j,0}}\right|\leq 10\%,\ i\neq j.$$

Furthermore, it was found that in the case of a deviation of the ratios of the angular velocities during deceleration of less than or equal to 5%, the fluctuation of the target thicknesses of the workpieces actually achieved upon standstill and at the end of the pass, within the scope of the measurement accuracy, is identical to the fluctuation with almost exactly (deviation<1%) constant ratios of the angular velocities. Deceleration with fluctuations of the rotational speed ratios by significantly less than 5% did not yield any improvement in the thickness fluctuations obtained within the scope of the measurement accuracy and is therefore particularly preferred.

In order to realize a closed-loop control of the drives with control deviations<1% for comparison purposes, the control characteristic of the force control units (inverters) that feed or take away power can be changed such that very high powers are fed or taken away even in the case of small rotational speed deviations. This results in a very "stiff" (low-slip) closed-loop control; but at the expense of high losses in the inverters and a greatly reduced maximum power which can be fed to the drives on average and whilst maintaining the stiff control characteristic. Continuous operation under such conditions would be uneconomic and inefficient and would demand the use of disproportionately overdimensioned drives and force control units.

While the described methods according to the invention for decelerating the drives completely achieve the object on which the invention is based, it proved to be advantageous if, at the same time as the deceleration of the installation drives, the grinding pressure conveyed by the applied load of the upper working disk is also reduced as rapidly as possible. Rapidly reducing the pressure makes it possible for the total magnitude of the "after-grinding" to be reduced further.

In this case, it was found to be largely unimportant whether the pressure was in this case reduced linearly, progressively or degressively. What was crucial for after-grinding reduced further was the total time in which the pressure was reduced. This is advantageous since the characteristic of the pressure reduction can thereby be chosen such that, even in the case of low residual pressures, the workpieces and the carriers can still be guided reliably between the working disks, without a situation in which, by way of example, the upper working disk, on account of fluctuations during the control of the pressure application, already lifts off in part with drives still rotating and the semiconductor wafers leave the carriers, which would lead to fracture.

Finally, however, it also proved to be advantageous if the pressure was reduced only slowly, such that even with all the drives at a standstill, a residual applied load of the upper working disk on the workpieces was still present. As a result, although the magnitude of the "after-grinding" increased, the latter proved to be very constant from pass to pass, such that good flatnesses and small thickness fluctuations continued to be obtained; however, such PPG passes were particularly reliable. This is because if, as often occurs for example in the case of older double-side apparatuses, the cardanic suspension of the upper working disk is stiff and sluggish, the upper working disk already begins to wobble in the case of a residual applied load of greater than zero and can partially lift off in part already in the case of still considerable load values. In this case, semiconductor wafers can leave the receptacle openings in the carriers, and fracture occurs. Therefore, it is often advantageous to still maintain a certain residual applied load until the drives are completely at a standstill.

The present invention can be used in all methods wherein a plurality of workpieces are simultaneously processed in a material-removing fashion on both sides, wherein the workpieces are guided by means of one or a plurality of guide cages in a freely movable fashion between a rotating upper working disk and a rotating lower working disk of a double-side processing apparatus. These are the group double-side processing methods described in the section "Background". The invention has been described for a double-side processing method with planetary kinematics, but can likewise be applied to orbital methods.

In a method with planetary kinematics, the working disks are ring-shaped. As guide cages, per processing pass at least three circular carriers each having at least one cutout for a workpiece and each having a toothing extending circumferentially on the circumference of the carriers are used. The toothing engages into an outer and an inner drive ring, which are in each case arranged concentrically with respect to the rotational axis of the working disks. As a result of the rotation of the two drive rings, the guide cages are moved circumferentially with simultaneous inherent rotation about the rotational axis of the working disks, such that the workpieces describe cycloidal trajectories relative to the two working disks.

In an orbital method, the working disks are not ring-shaped, but rather circular. Precisely one guide cage is used, which covers the entire area of the working disks. It is driven to effect an orbital movement by eccentrically rotating guide rollers arranged on the circumference of the working disks. The orbital method differs fundamentally from planetary kinematics with regard to the movement sequence. The orbital method is characterized by the fact that in the resting reference system (laboratory system) for each workpiece there is always a respective stationary area which is completely covered by the workpiece at any time, since the one guide cage holding the workpieces does not change its angular orientation with respect to the resting laboratory system during the process of describing the orbital movement. By contrast, the method with planetary kinematics is characterized by the fact that the workpieces are inserted into a plurality of carriers which generally rotate around the center of the processing apparatus by means of the rolling apparatus formed from the inner and outer drive rings of the processing apparatus. As a result of the rotation of the carriers, therefore, in the method with planetary kinematics, there is generally no stationary area in the resting laboratory system which is completely covered by the workpiece at any time. Although, in the method with planetary kinematics, the rotational speeds of the drive rings can also be chosen in the specific case such that the mid-points of the carriers are kept stationary with respect to the resting laboratory system during the material-removing processing of the workpieces, that is to say that the carriers do not rotate, they then necessarily describe an inherent rotation (rotation about their respective mid-points), such that, in contrast to the orbital method, their angular orientation is subject to a continuous change.

The invention can be applied in the case of lapping, polishing and grinding, wherein the problem addressed, as described above, is by far the greatest in the case of grinding. Therefore, an application of the invention in the case of grinding is particularly preferred. However, an application in the case of lapping or polishing is likewise possible in order to further improve the dimensional accuracies in respect of target thicknesses obtained there, which are already good in accordance with the prior art.

What is claimed is:

1. A method for simultaneous double-side material-removing processing of at least three workpieces, the method comprising:

disposing the at least three workpieces in a working gap between a rotating upper working disk and a rotating lower working disk of a double-side processing apparatus, each workpiece lying in freely movable fashion in a respective opening of a guide cage;

moving the at least three workpieces under pressure in the working gap using the guide cage; and upon attaining a preselected target thickness of the workpieces, initiating a deceleration process including reducing an angular velocity $\omega_i(t)$ of a respective drive i of each of the upper working disk, the lower working disk and the guide cage to a standstill, the reducing being carried out such that ratios of the angular velocities $\omega_i(t)$ with respect to one another as a function of time t deviate by no more than 10% from initial ratios of the angular velocities $\omega_i(t)$ corresponding to when the preselected target thickness was attained.

2. The method as claimed in claim 1, wherein the the reducing is carried out such that ratios of the angular velocities $\omega_i(t)$ with respect to one another as a function of time t deviate by no more than 5% from initial ratios of the angular velocities $\omega_i(t)$ corresponding to when the preselected target thickness was attained.

3. The method recited in claim 1, wherein the working disks are ring-shaped, and the method uses at least three circular guide cages each having at least one cutout for a respective workpiece and each having a toothing extending circumferentially on a circumference of the guide cage, wherein the toothing engages into an outer and an inner drive ring, which are respectively arranged concentrically with respect to a rotational axis of the working disks, and wherein the two drive rings constitute the drives of the guide cages by means of which the guide cages are moved circumferentially with simultaneous inherent rotation about the rotational axis of the working disks, such that the workpieces describe cycloidal trajectories relative to the two working disks.

4. The method recited in claim 1, wherein the working disks are circular and the method uses exactly one guide cage, which covers an entire area of the working disks and is driven by eccentrically rotating guide rollers arranged on a circumference of the working disks to effect an orbital movement such that in a resting reference system for each workpiece there is a respective stationary area which is completely covered by the workpiece at any time.

5. The method recited in claim 1, wherein the angular velocity $\omega_i(t)$ of each drive i is reduced in accordance with $\omega_i(t)=\omega_{i,0}-k_i/J_i t$, wherein $\omega_{i,0}$ denotes an initial angular velocity at a beginning of the deceleration process, $J_i$ denotes a moment of inertia where $J_i=\int\rho_i(\tau)r^2 d\tau$, $\rho_i(\tau)$ denotes a density distribution, r denotes a distance from an axis of rotation, $k_i$ denotes a deceleration capacity of the drive i, dr denotes an infinitesimal element of a volume r that encompasses rotating parts of the drive i, and t denotes time.

6. The method recited in claim 1, wherein a magnitude of a change in the angular velocity $\omega_i(t)$ of each drive i per unit time increases in a course of the deceleration process.

7. The method recited in claim 6, wherein the angular velocity $\omega_i(t)$ of each drive i is reduced in accordance with $$\omega_i(t) = \sqrt{\omega_{i,0}^2 - \frac{2k_i}{J_i} t},$$

wherein $\omega_{i,0}$ denotes an angular velocity at a beginning of the deceleration process, $J_i$ denotes a moment of inertia where $J_i=\int\rho_i(\tau)r^2 d\tau$, $\rho_i(\tau)$ denotes a density distribution, r denotes a distance from an axis of rotation, $k_i$ denotes a deceleration capacity of the drive i, $d\tau$ denotes an infinitesimal element of a volume $\tau$ that encompasses rotating parts of the drive i, and t denotes time.

8. The method recited in claim 1, wherein a duration $t_{br}$ of the deceleration process is determined by the respective drive i with a greatest angular momentum $L_i=J_i\omega_{i,0}$, wherein $\omega_{i,0}$ denotes an angular velocity at a beginning of the deceleration process, $J_i=\int\rho_i(\tau)r^2d\tau$ denotes a moment of inertia, $\rho_i(\tau)$ denotes a density distribution, r denotes a distance from an axis of rotation, dr denotes an infinitesimal element of a volume $\tau$ that encompasses rotating parts of the drive i, and t denotes time.

9. The method recited in claim 1, wherein the pressure exerted on the workpieces by the upper and lower working disks is reduced during the deceleration process.

10. The method recited in claim 9, wherein the pressure at the end of the deceleration process is greater than zero.

11. The method recited in claim 1, wherein each working disk respectively carries a working layer containing fixedly bonded abrasive which, through contact with the workpieces, brings about material removal from the workpieces by grinding.

* * * * *